US007264517B1

(12) United States Patent
Piromalli

(10) Patent No.: US 7,264,517 B1
(45) Date of Patent: Sep. 4, 2007

(54) UNIPOLAR SAFETY ELECTRIC CONNECTOR AND RELEVANT MULTIPOLAR GUIDED CONNECTION SYSTEM

(75) Inventor: Marco Piromalli, Rome (IT)

(73) Assignee: Link S.r.L., Rome (IT)

( * ) Notice: Subject to any disclaimer, the term of this patent is extended or adjusted under 35 U.S.C. 154(b) by 0 days.

(21) Appl. No.: 11/505,981

(22) Filed: Aug. 18, 2006

(51) Int. Cl.
*H01R 13/64* (2006.01)

(52) U.S. Cl. ..... 439/681; 439/314; 439/318

(58) Field of Classification Search ..... 439/314, 439/318, 681
See application file for complete search history.

(56) References Cited

U.S. PATENT DOCUMENTS 3,287,031 A * 11/1966 Simmons et al. ..... 285/27
3,614,711 A * 10/1971 Anderson et al. ..... 439/314
4,440,464 A * 4/1984 Spinner ..... 439/218
6,280,221 B1 * 8/2001 Fukase et al. ..... 439/315
6,808,407 B1 * 10/2004 Cannon ..... 439/314
7,104,826 B2 * 9/2006 Zahlit et al. ..... 439/314
2006/0240698 A1 * 10/2006 Sanuki et al. ..... 439/314

* cited by examiner

*Primary Examiner*—Tho D. Ta
(74) *Attorney, Agent, or Firm*—Young & Thompson

(57) ABSTRACT

A unipolar safety electric connector includes a male connector, shell, and a female connector shell, corresponding male and female inner electric contacts being provided within the male and female connectors, the female connector shell providing on its outer portion a "L" shaped guide groove, having one arm along the longitudinal coupling direction of the shells and the other arm along the transverse direction, a key being insertable within the "L" shaped groove, the key being provided on the edge of the male connector shell, the key, once introduced longitudinally at the bottom of the "L" shaped guide groove, engaging, by rotation of one shell with respect to the other one, with the transverse arm of the "L" shaped guide groove.

15 Claims, 9 Drawing Sheets

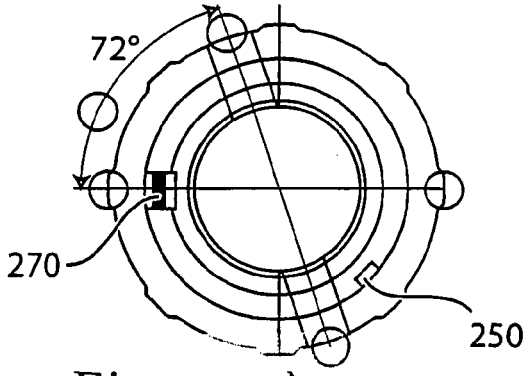
Fig. 9 a)
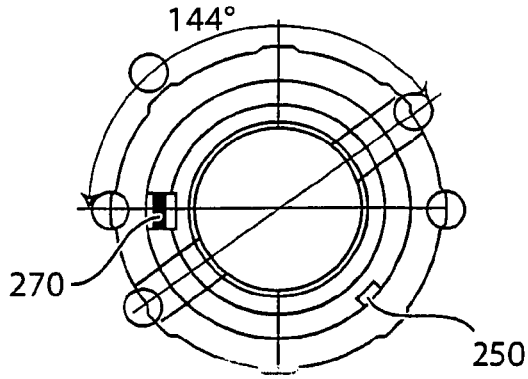
Fig. 9 b)
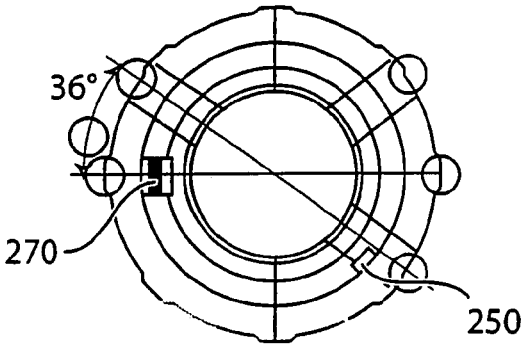
Fig. 9 c)
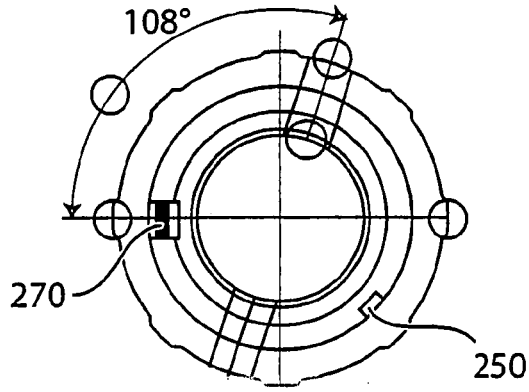
Fig. 9 d)
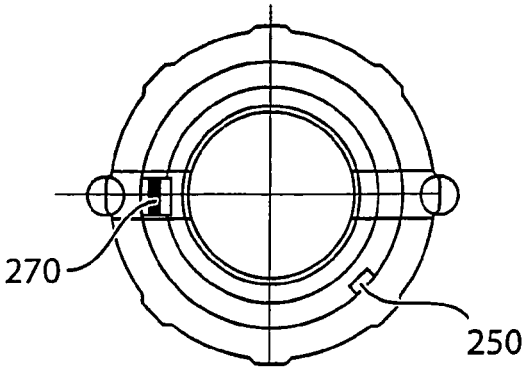
Fig. 9 e)
Fig. 9

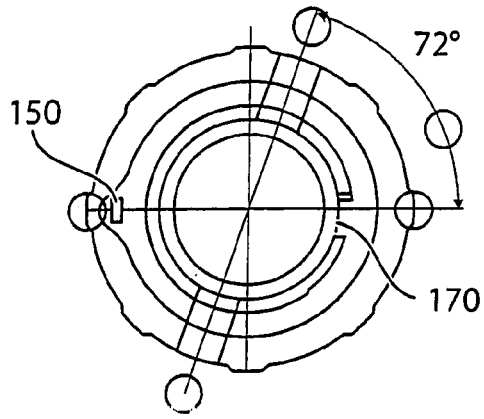
Fig. 10 a)
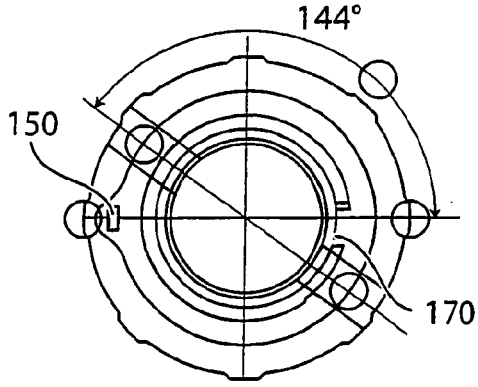
Fig. 10 b)
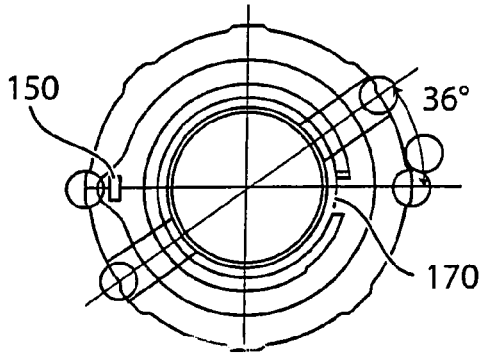
Fig. 10 c)
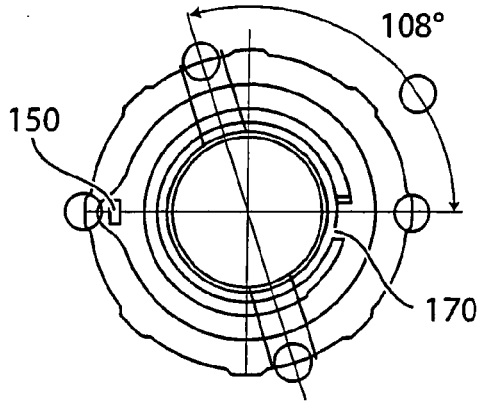
Fig. 10 d)
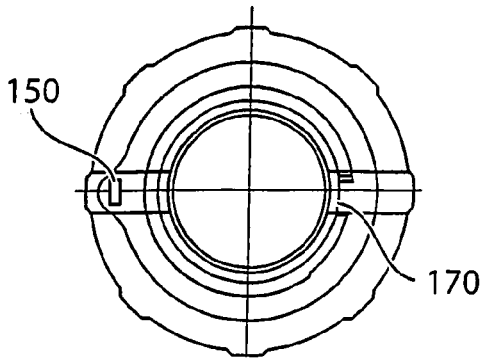
Fig. 10 e)
Fig. 10

UNIPOLAR SAFETY ELECTRIC CONNECTOR AND RELEVANT MULTIPOLAR GUIDED CONNECTION SYSTEM

The present invention relates to a unipolar safety electric connector and relevant multipolar guided connection system.

More specifically, the connector according to the invention comprises a very advantageous connection between male and female outer shells. Said connection is exploited in the electric connection system according to the invention, wherein inner male and female contacts are positioned with respect to the coupling references of the same shells, so that coupling between the two shells automatically and univocally places the inner electric contacts for a set polarity or phase, making it impossible coupling of two connectors with different polarity or phase.

Male/female electric contacts are widely known, such as jack type contact for acoustic apparatuses, or those used for recharging many electronic devices such as cellular phone.

Male electric contact is usually comprised of a cylinder, or of a cylindrical crown, coated on the outer face by a metallic material.

Female contact is a hollow cylinder having dimensions corresponding to those of the male contact, and provided inside with a conductor material suitable to contact the corresponding surface of the male contact as soon as it is properly introduced within the same female contact.

Female contact can contain safety devices in order to prevent involuntary contact with the electrically energised inner region.

Male-female contacts are known as well wherein female contact has inside a mechanical reference corresponding to a particular configuration of the male contact, so that a guided coupling between the two contacts is obtained.

Safety of said connection is not high, since when the same type of contact connects different phases, it is evident that it is possible connecting by mistake male contact of a first phase with female contact of a different phase or polarity, even in case different colours individuate them.

Object of the present invention is that of providing a high power, multipolar, guided phase electric connection system solving the above problems and overcoming the drawbacks of the prior art.

Further object of the present invention is that of providing a high power male-female contact that can be used in the system according to the invention, using the most known standard inner contacts.

It is subject matter of the present invention a unipolar safety electric connector, comprising a male connector shell and a female connector shell, corresponding male and female inner electric contacts being provided within said male and female connectors, the female connector shell providing on its outer portion a "L" shaped guide groove, having one arm along the longitudinal coupling direction of the shells and the other arm along the transverse direction, a key being insertable within said "L" shaped groove, said key being provided on the edge of the male connector shell, said key, once introduced longitudinally at the bottom of said "L" shaped guide groove, engaging, by rotation of one shell with respect to the other one, with the transverse arm of said "L" shaped guide groove, so as to prevent every decoupling by direct moving away according to a longitudinal direction of the male connector shell from female connector shell, said female connector shell further comprising, laterally, an elastic tab suitable to engage, by the same above rotation of one shell with respect to the other one, within a corresponding notch, said elastic tab being suitable to exert a pressure on the bottom of said notch so as that, once two shells are coupled, it is necessary temporarily lifting said tab in order to be able to rotate them each other.

Preferably, according to the invention, said elastic tab and said notch are almost provided according to the longitudinal coupling direction of the connector.

Preferably, according to the invention, said key is an element separated with respect to the male contact shell and it is releasably coupled with the same.

Preferably, according to the invention, said key can be fixed bridging on a corresponding edge portion on the male contact shell opening to be brought toward the female contact.

Preferably, according to the invention, said key comprises a first arc with a suitable check tooth, in which said edge portion can be fixed, and a second arc on which it is possible acting by a suitable tool in order to unlock said key.

Preferably, according to the invention, said key can be fixed to said female contact shell so that in a first position it projects inside by a first thickness lower than d1, and in a second position projects inside by a second higher thickness d2, said first and second thickness being sized in such a way that by first thickness oriented inside it is possible connecting also a shell of another female contact without said guide groove, while this coupling is prevented if said second thickness d2 is oriented inside.

It is further object of the present invention a multipolar safety electric connection system, employing more than one safety electric contacts according to the invention, wherein inner female contact comprises a reference mechanical element projecting from the inner surface, inner male contact being a male element without rotational symmetry, suitable to be introduced within the inner female contact guided by said mechanical element and suitable to be subjected to a partial rotation, always guided by the same mechanical element, phase or polarity of the male electric contact being determined by a first relevant angular position between said key and the angular position of the inner male contact portion that must slide aside said mechanical element, phase or polarity of the corresponding female electric contact being determined by a second angular position of said guide groove with respect to said mechanical element, said second angular position having the same absolute value and corresponding to said first angular position, said first and second angular position varying on the basis of the specific phase or polarity so that each male contact can be only introduced within a female contact having the same phase or polarity.

Preferably, according to the invention, shape of said inner male contact is always the same, the position of a coupling transverse hole varying so that coupling of said inner male contact with the shell automatically determines said first angular position.

Advantageously, according to the invention, said first angular position is 72° for ground unipolar connector, 144° for neutral unipolar connector, 36° for L1 phase unipolar connector, 108° for L2 phase unipolar connector, and 0° for L3 phase unipolar connector.

BRIEF DESCRIPTION OF THE DRAWINGS

The present invention will be now described, for illustrative but not limitative purposes, according to its preferred embodiments, with particular reference to the figures of the enclosed drawings, wherein:

FIGS. 9 (*a*–*e*) show an embodiment of arrangements relevant to the connection elements of the male contact when five phases of polarities according to the invention are provided;

FIGS. 10 (*a*–*e*) show an embodiment of arrangements concerning embodiments of female contact couplings when five phases of polarities according to the invention are provided;

DETAILED DESCRIPTION OF THE INVENTION

Figure 1:
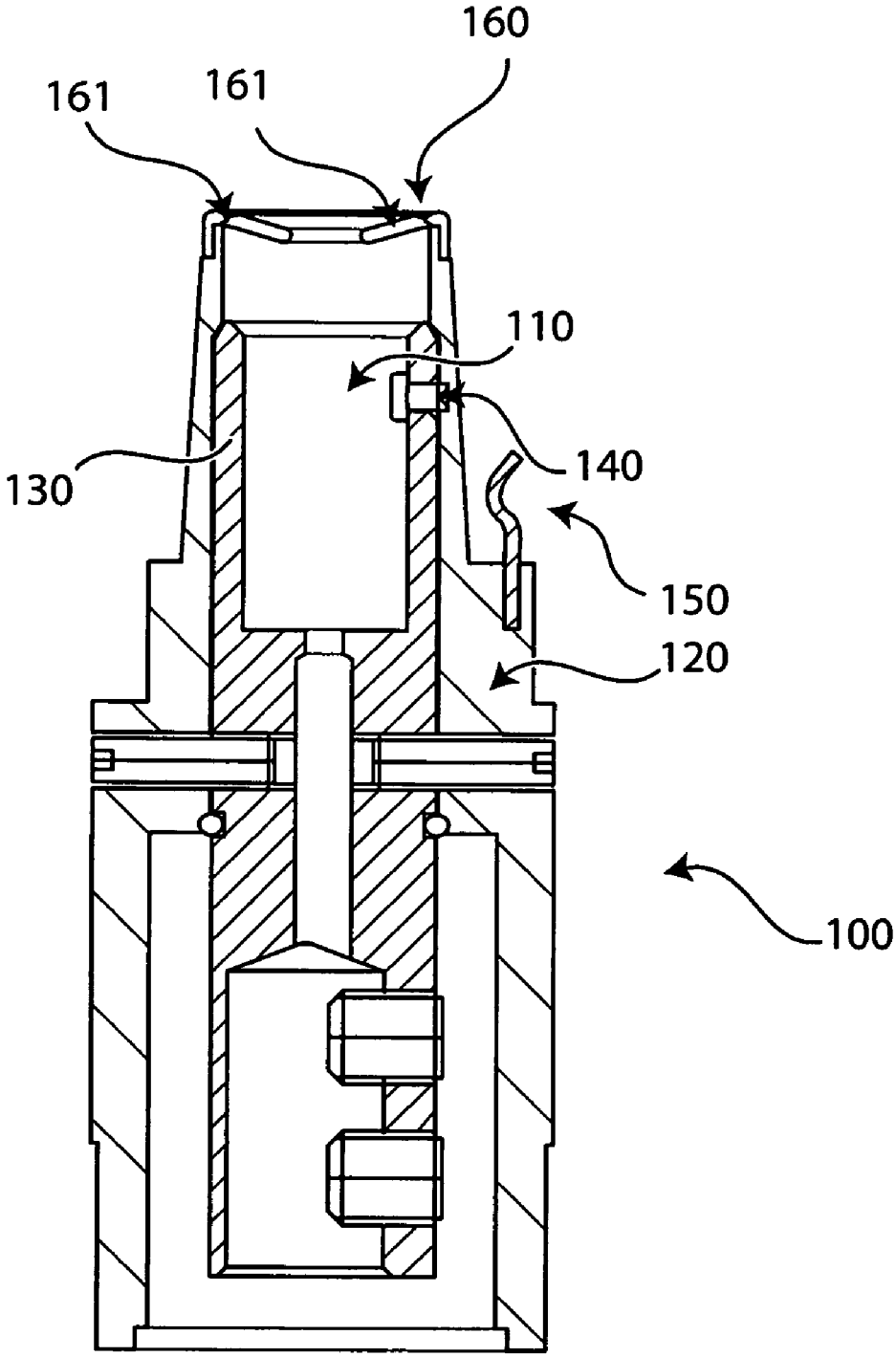
FIG. 1 shows a section view of an embodiment a free female contact according to the present invention.

Making reference to FIG. 1, female contact 100 provides an insulating shell 120 and comprises an at least partly conductive inner wall 130. Thus an inner cavity 110 is defined. A mechanical element 140 is inserted within said inner wall 130, projecting within said cavity 110, and acting as mechanical reference for male contact.

It must be observed the elastic tab 150 on the outer shell, said tab comprising a coupling element with a corresponding part of the male outer shell.

Still, a protection against unintentional contact (e.g. a screwdriver) 160 is advantageously is provided at the entrance of female contact 100. Said protection 160 is comprised of tabs 161 coupled with periphery and extending up to the centre or up to a set region of the female contact 100 lumen.

It must be pointed out that female contact can comprise inside a further safety device against unintentional contacts, said further device not being described in further detail in the following.

Figure 2:
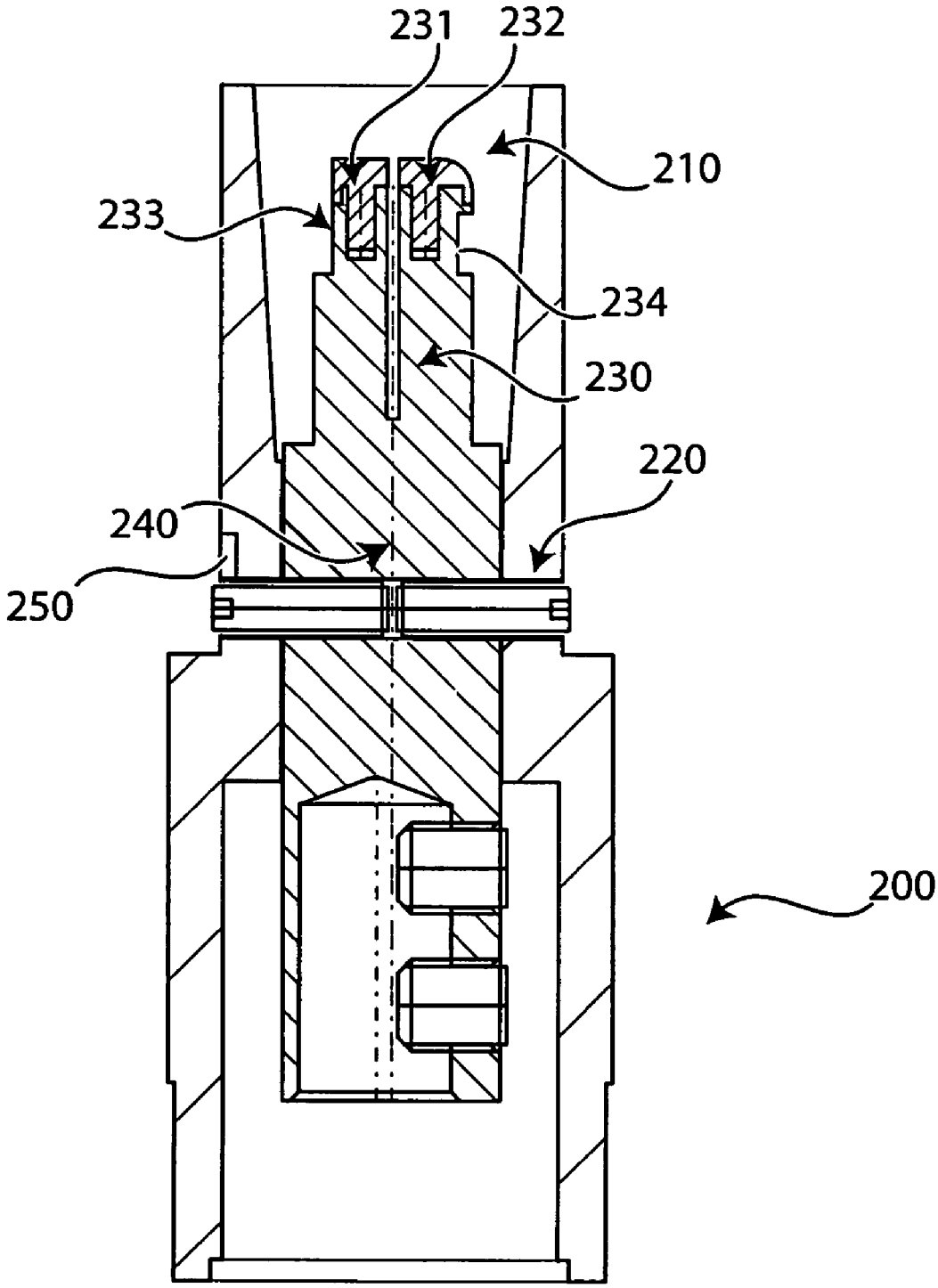
FIG. 2 shows a section view of an embodiment a free male contact according to the present invention.

Making now reference to FIG. 2, male contact 200 provides an outer shell 220, with an inner male element 230, shaped to conform to the cavity 110 of the female contact 100 described in the above. Said male element 239 is asymmetrical with respect to the symmetry axis 240 of the female contact 200. In fact, a part 232 has a circle shape, while the other part is so cut to slide aside the mechanical element 140 of female contact 100.

A notch 250 is provided laterally with respect to the outer shell 200, said notch receiving the corresponding elastic tab 150 of the female contact shell, so that to decouple the male contact from the female contact it will be necessary lifting said tab 150, for example by a quick release key.

Figure 3:
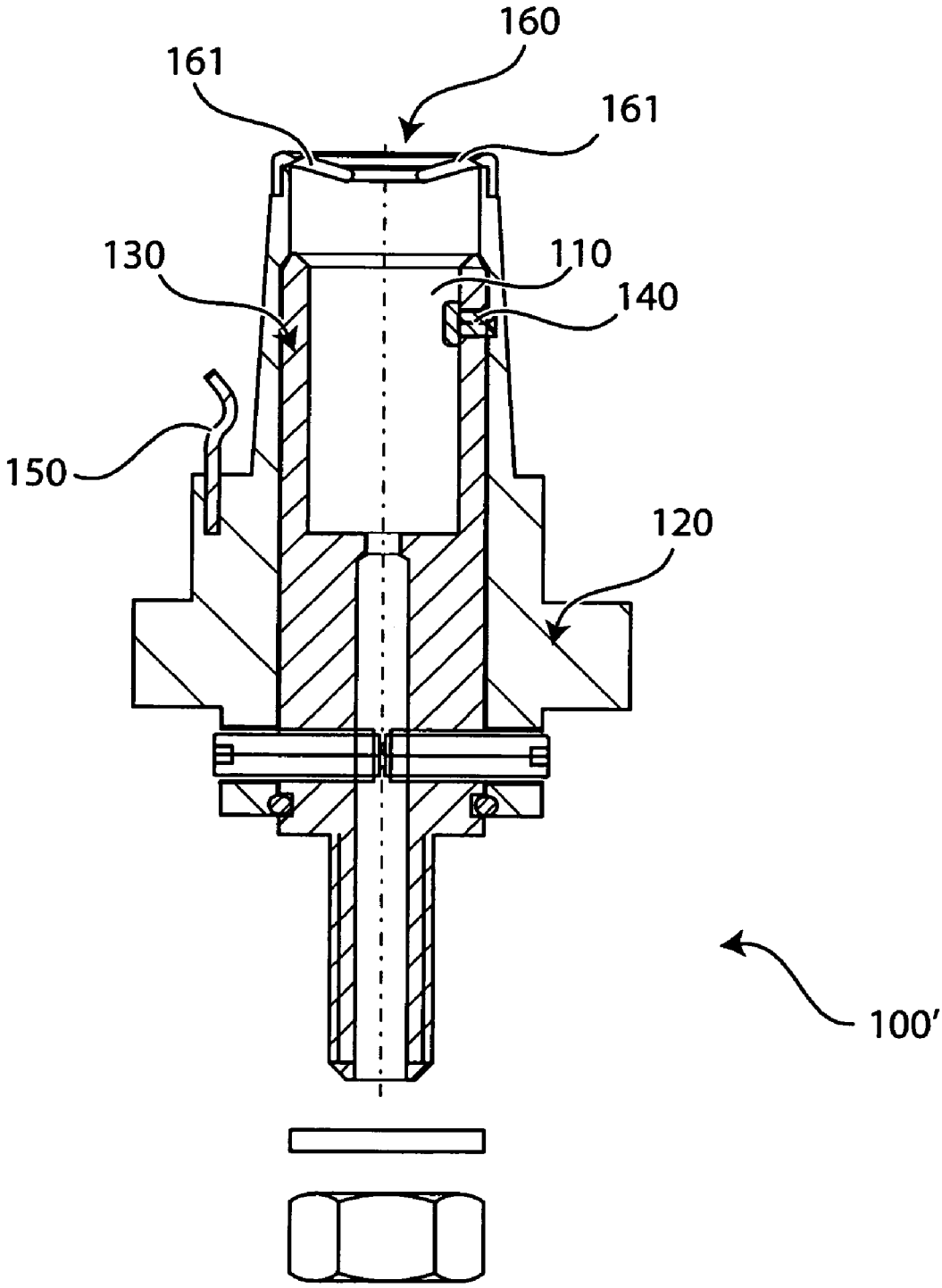
FIG. 3 shows a section view of an embodiment a panel fixed female contact according to the present invention.
Figure 4:
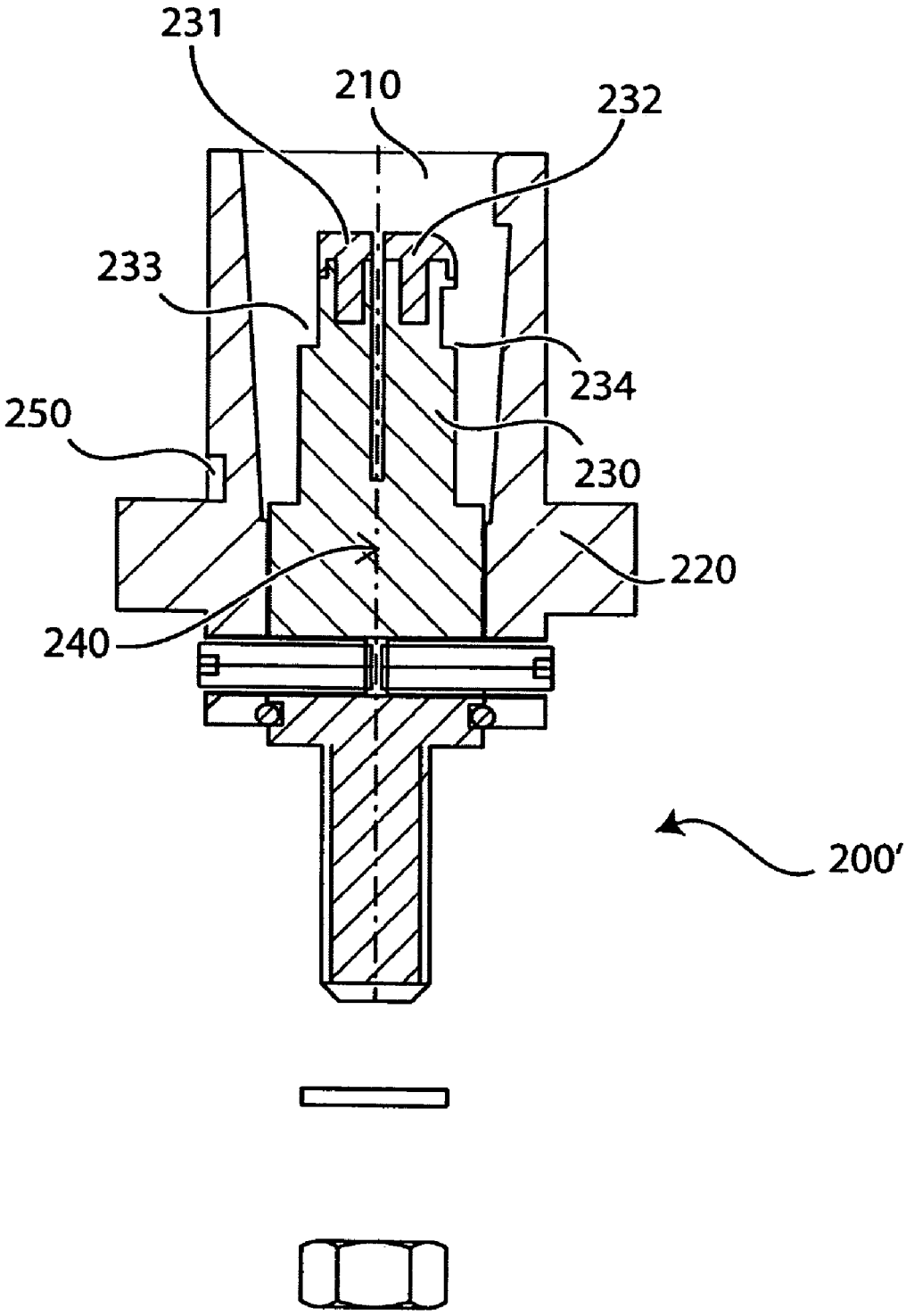
FIG. 4 shows a section view of an embodiment a panel fixed male contact according to the present invention.

Female 100' and male 200' devices are shown in FIGS. 3 and 4, said devices having identical coupling part with respect to those shown in FIGS. 1 and 2, but they have a base to be fixed on a panel.

Figure 5:
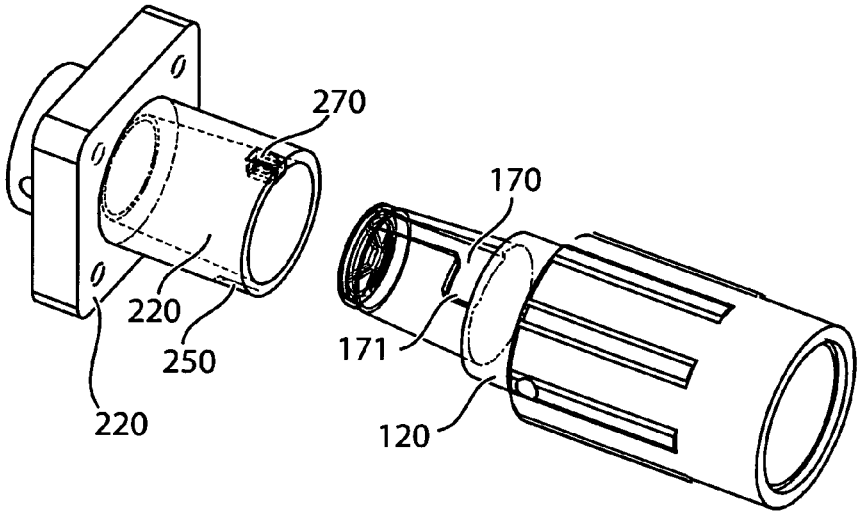
FIG. 5 shows a perspective view of an embodiment of outer housings or "shells" of male and female contact with the relevant safety couplings according to the present invention.

An example of the shells 120, 220 for electric contacts (male panel and free female) of FIGS. 1–4 are represented in FIG. 5, wherein it is shown the guide groove and the guide 170 (acting also as guide means) of female shell coupling with the corresponding key 270 of female shell. Once introduced one shell within the other one, it will be necessary rotating female contact so that key 270 engages in the right angle part 171 of guide groove 170, thus preventing decoupling of male and female contacts by longitudinal traction. By the same rotation, elastic tab 150 (not shown in FIG. 5) will engage within notch 250, pushing the same downward, notch and inclination of the tab being suitable not to permit a rotation of a contact with respect to the other one unless a suitable quick release key lifts tab 150, preferably.

Figure 8:
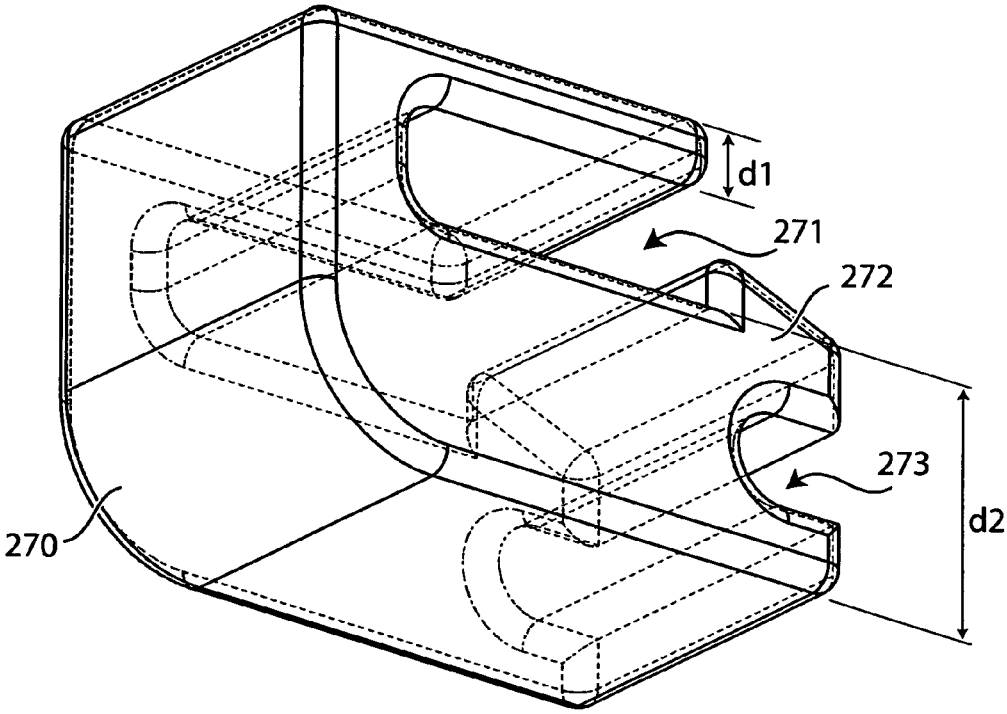
FIG. 8 particularly shows an element of the shell of male contacts of FIGS. 5–7.

It must be noted that key 270 can be removed or repositioned in a different way. In fact, as shown in FIG. 8, arc 271 engages with corresponding portion of wall 220, and is fixed thanks to the teeth 272. A smaller arc 272 remains free, to be engaged by a suitable release tool for removal of the key 270.

Reversibility of said key 270 has been set to adapt connector to the different applicative situations. In fact, it is known that different connectors, with or without guide groove, are available on the market. Consequently, when bigger thickness part d2 of key 270 is inside the male connector shell, it is compulsory using female connector shell with guide groove 170. Instead, when key 270 is mounted inverted, i.e. with minor thickness d1 inside the male connector shell, the same male connector shell can be used with a female connector shell without the groove. In this way, a universal male connector shell is obtained, with the remarkable advantage that element by which said feature is obtained, i.e. the key 270, is always fixed to the male connector shell and thus it is not lost.

Figure 6:
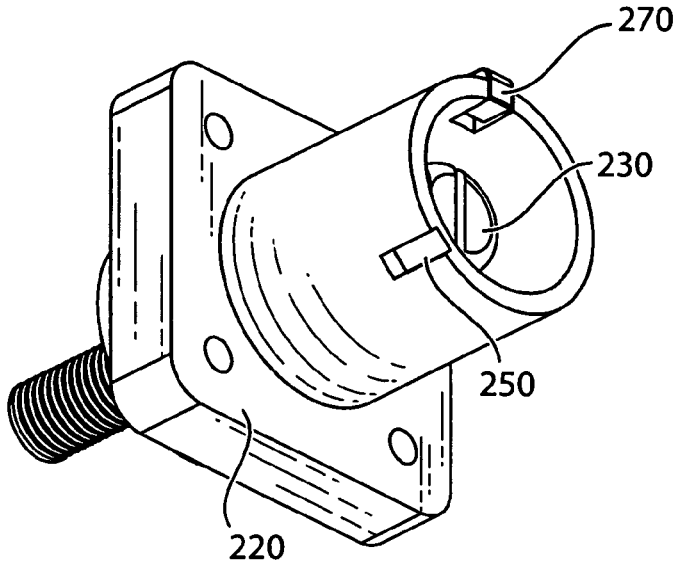
FIG. 6 shows a perspective view of an embodiment of a panel male contact according to the present invention.
Figure 7:
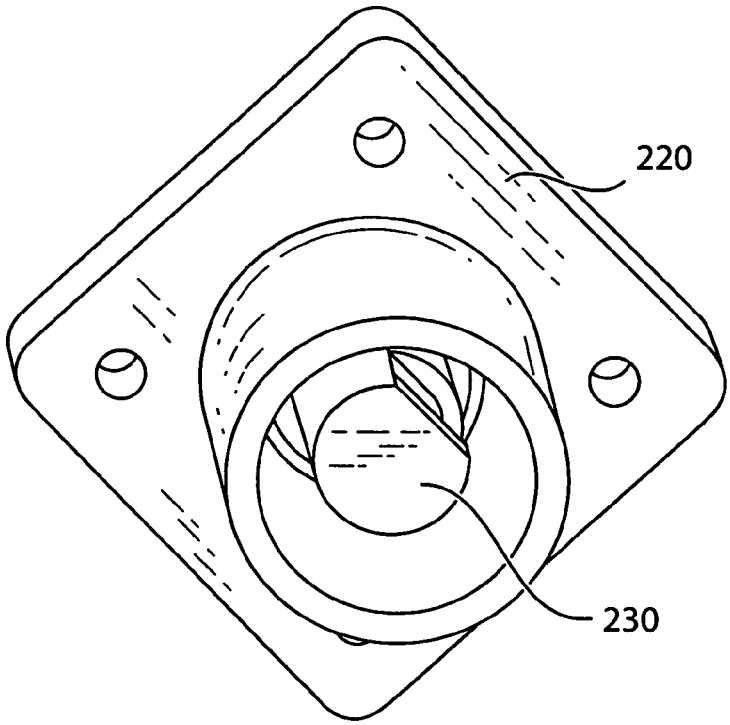
FIG. 7 shows a further perspective view of contact of FIG. 6.

From FIGS. 6 and 7 it is possible observing in two different perspective views panel male connector both with shell 220 and with inner male element 230.

Now, since as already said, inner male element 230 has not a rotational symmetry along its longitudinal axis, but a cut 233 to be positioned in correspondence of the above mechanical element 140 of female contact (as well as a groove 234 along a circumference arc in order to permit rotation without being hindered by mechanical element 140), it is well clear that position of female contact shell groove 170 must be provided in such a way that inner male element 230 is properly positioned for its introduction.

This simultaneous positioning is exploited by the system according to the invention in order to obtain a univocal coupling of the five power electric contact phases.

In fact, setting different relative angular positions of the guide groove 170 (as well as of the key 270) and of inner male element 230 (as well as of the mechanical element 140) it is evident that coupling of shells will correspond to a unique position of inner male/female elements, i.e. to a single specific phase.

The above feature gives an absolute protection against risks of connecting different phases.

Examples of these relative angular positioning are shown in FIGS. 9 and 10, wherein example (a) refers to ground unipolar connector, example (b) refers to neutral unipolar connector, example (c) refers to L1 phase unipolar connector, example (d) refers to L2 phase unipolar connector, example (e) refers to L3 phase unipolar connector.

In FIG. 9, wherein male contact example is shown (i.e. female shell) angles indicated are calculated starting from an arbitrary reference (e.g. key 270) up to the transverse hole (not shown) of inner male element 230 permitting positioning of the latter within the shell. From FIG. 9 it also possible observing position of notch 250 within which elastic tab engages.

In the same way, in FIG. 9, wherein female contact example is shown (i.e. male shell) angles indicated are calculated starting from an arbitrary reference (e.g. guide groove 170) up to the transverse hole (not shown) of inner female element permitting positioning of the latter within the shell. From FIG. 10 it also possible observing position of the seat of the elastic tab 150.

Figure 11:
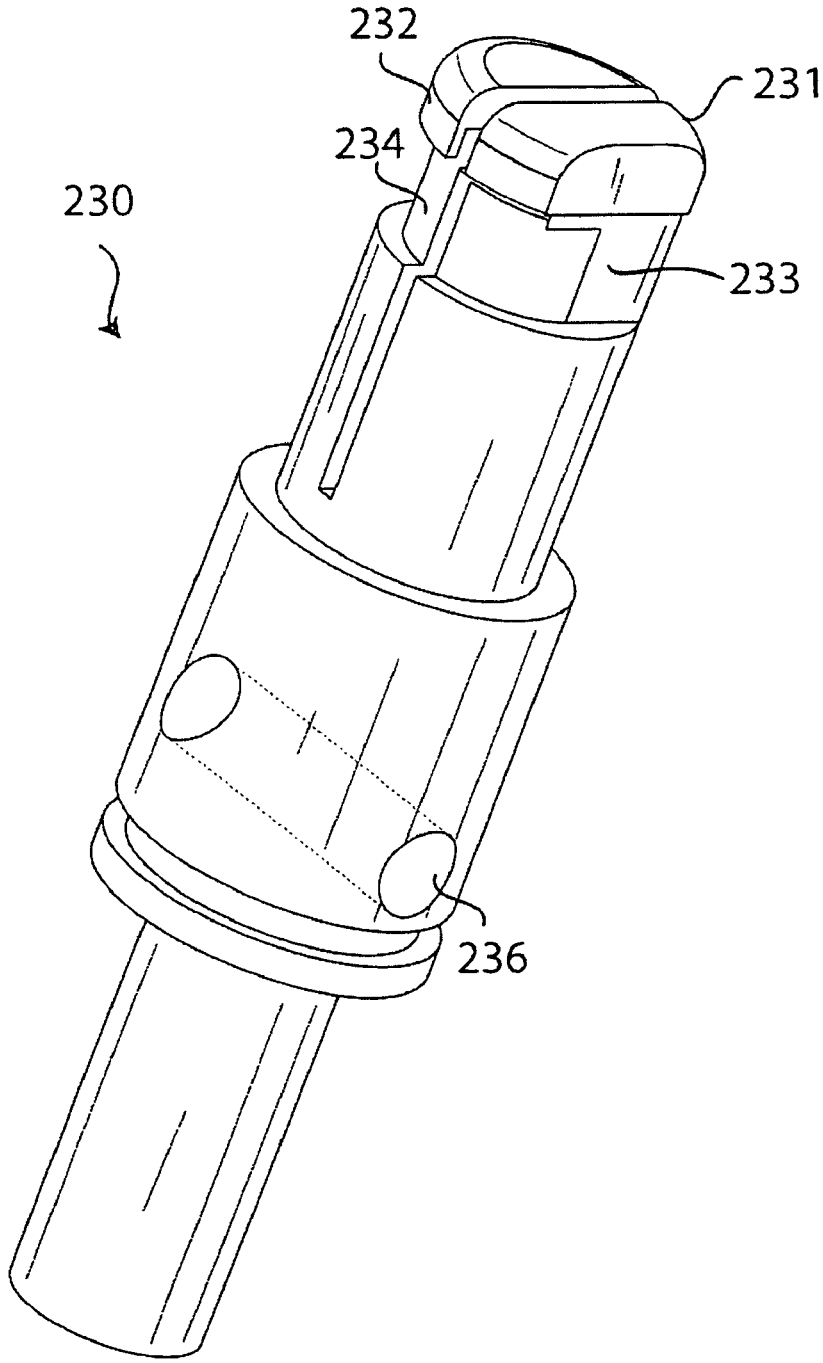
FIG. 11 shows a perspective view of the contact male inner element of FIGS. 1–8.

Male element 230 is shown provided with transverse hole 236 for exemplificative purposes in FIG. 11. it must be noted that, rotating said male element once introduced within the female contact, said male contact is blocked within female contact due to the fact that mechanical element 140 engages within groove 234. Consequently, it would suffice this action for blocking contacts without guide groove 170 of female contact, which is a safety groove. However, as already said, system according to the invention exploits said guide groove for guided multipolar connection, maintaining the mechanical function of the same groove that in this case is not a primary function.

Thanks to the connector and to the system according to the invention, is greatly improved safety of high power electric coupling, since when different phases are connected by the same kind of contact, it is well evident that it is not possible coupling by mistake male of a phase with female of another phase. Furthermore, it is possible using many parts of the present standards, thus the connector according to the invention being easily conformable to these standards, and consequently reducing manufacturing and/or replacement costs.

The present invention has been described for illustrative but not limitative purposes, according to its preferred embodiments, but it is to be understood that modifications and/or changes can be introduced by those skilled in the art without departing from the relevant scope as defined in the enclosed claims.

The invention claimed is:

1. Unipolar safety electric connector, comprising a male connector (200) shell (220) and a female connector (100) shell (120), corresponding male (230) and female (130) inner electric contacts being provided within said male (200) and female (100) connectors, the female connector (100) shell (130) providing on its outer portion a "L" shaped guide groove (170), having one arm along the longitudinal coupling direction of the shells and the other arm (171) along the transverse direction, a key (270) being insertable within said "L" shaped groove (170), said key (270) being provided on the edge of the male connector (200) shell (220), said key (270), once introduced longitudinally at the bottom of said "L" shaped guide groove (170), engaging, by rotation of one shell with respect to the other one, with the transverse arm (171) of said "L" shaped guide groove (170), so as to prevent every decoupling by direct moving away according to a longitudinal direction of the male connector (200) shell (220) from female connector (100) shell (120), said female connector (100) shell (120)

wherein inner female contact (130) comprises a reference mechanical element projecting from the inner surface, inner male contact (230) being a male element (230) without rotational symmetry, suitable to be introduced within the inner female contact guided by said mechanical element (140) and suitable to be subjected to a partial rotation, always guided by the same mechanical element (140), phase or polarity of the male electric contact (200) being determined by a first relevant angular position between said key (270) and the angular position of the inner male contact (230) portion (231, 233) that must slide aside said mechanical element (140), phase or polarity of the corresponding female electric contact being determined by a second angular position of said guide groove (170) with respect to said mechanical element (140), said second angular position having the same absolute value and corresponding to said first angular position, said first and second angular position varying on the basis of the specific phase or polarity so that each male contact can be only introduced within a female contact having the same phase or polarity.

2. Connector according to claim 1, further comprising, laterally, an elastic tab (150) suitable to engage, by the same above rotation of one shell with respect to the other one, within a corresponding notch (250), said elastic tab (150) being suitable to exert a pressure on the bottom of said notch (250) so as that, once two shells (120, 220) are coupled, it is necessary temporarily lifting said tab in order to be able to rotate them each other, characterised in that said elastic tab (150) and said notch (250) are almost provided according to the longitudinal coupling direction of the connector.

3. Connector according to claim 1, characterised in that said key (270) is an element separated with respect to the male contact (200) shell (220) and it is releasably coupled with the same.

4. Connector according to claim 3, characterised in that said key (270) is fixed to said female contact shell so that in a first position it projects inside by a first thickness lower than d1, and in a second position projects inside by a second higher thickness d2, said first and second thickness being sized in such a way that by first thickness oriented inside it is possible connecting also a shell of another female contact without said guide groove (170), while this coupling is prevented if said second thickness d2 is oriented inside.

5. Connector according to claim 3, characterised in that said key (270) is fixed bridging on a corresponding edge portion on the male contact (200) shell (220) opening to be brought toward the female contact (100).

6. Connector according to claim 5, characterised in that said key (270) comprises a first arc (271) with a suitable check tooth (272), in which said edge portion can be fixed, and a second arc (273) on which it is possible acting by a suitable tool in order to unlock said key (270).

7. Connector according to claim 1, characterised in that shape of said inner male contact (230) is always the same, the position of a coupling transverse hole (236) varying so that coupling of said inner male contact (230) with the shell automatically determines said first angular position.

8. Connector according to claim 7, characterised in that said first angular position is 72° for ground unipolar connector, 144° for neutral unipolar connector, 36° for L1 phase unipolar connector, 108° for L2 phase unipolar connector, and 0° for L3 phase unipolar connector.

9. Unipolar safety electric connector, comprising a male connector (200) shell (220) and a female connector (100) shell (120), corresponding male (230) and female (130) inner electric contacts being provided within said male (200) and female (100) connectors, the female connector (100) shell (130) providing on its outer portion a "L" shaped guide groove (170), having one arm along the longitudinal coupling direction of the shells and the other arm (171) along the transverse direction, a key (270) being insertable within said "L" shaped groove (170), said key (270) being provided on the edge of the male connector (200) shell (220), said key (270), once introduced longitudinally at the bottom of said "L" shaped guide groove (170), engaging, by rotation of one shell with respect to the other one, with the transverse arm (171) of said "L" shaped guide groove (170), so as to prevent every decoupling by direct moving away according to a longitudinal direction of the male connector (200) shell (220) from female connector (100) shell (120), said female connector (100) shell (120) further comprising, laterally, an elastic tab (150) suitable to engage, by the same above rotation of one shell with respect to the other one, within a corresponding notch (250), said elastic tab (150) being suitable to exert a pressure on the bottom of said notch (250) so as that, once two shells (120, 220) are coupled, it is necessary temporarily lifting said tab in order to be able to rotate them each other, characterised in that said key (270) is an element separated with respect to the male contact (200) shell (220) and it is releasably coupled with the same.

10. Connector according to claim 9, characterised in that said key (270) is fixed to said female contact shell so that in a first position it projects inside by a first thickness lower than d1, and in a second position projects inside by a second higher thickness d2, said first and second thickness being sized in such a way that by first thickness oriented inside it is possible connecting also a shell of another female contact without said guide groove (170), while this coupling is prevented if said second thickness d2 is oriented inside.

11. Connector according to claim 9, characterised in that said key (270) is fixed bridging on a corresponding edge portion on the male contact (200) shell (220) opening to be brought toward the female contact (100).

12. Connector according to claim 11, characterised in that said key (270) comprises a first arc (271) with a suitable check tooth (272), in which said edge portion can be fixed, and a second arc (273) on which it is possible acting by a suitable tool in order to unlock said key (270).

13. Multipolar safety electric connection system, employing more than one unipolar safety electric connector, comprising a male connector (200) shell (220) and a female connector (100) shell (120), corresponding male (230) and female (130) inner electric contacts being provided within said male (200) and female (100) connectors, the female connector (100) shell (130) providing on its outer portion a "L" shaped guide groove (170), having one arm along the longitudinal coupling direction of the shells and the other arm (171) along the transverse direction, a key (270) being insertable within said "L" shaped groove (170), said key (270) being provided on the edge of the male connector (200) shell (220), said key (270), once introduced longitudinally at the bottom of said "L" shaped guide groove (170), engaging, by rotation of one shell with respect to the other one, with the transverse arm (171) of said "L" shaped guide groove (170), so as to prevent every decoupling by direct moving away according to a longitudinal direction of the male connector (200) shell (220) from female connector (100) shell (120), said female connector (100) shell (120) further comprising, laterally, an elastic tab (150) suitable to engage, by the same above rotation of one shell with respect to the other one, within a corresponding notch (250), said elastic tab (150) being suitable to exert a pressure on the bottom of said notch (250) so as that, once two shells (120, 220) are coupled, it is necessary temporarily lifting said tab in order to be able to rotate them each other, wherein inner female contact (130) comprises a reference mechanical element projecting from the inner surface, inner male contact (230) being a male element (230) without rotational symmetry, suitable to be introduced within the inner female contact guided by said mechanical element (140) and suitable to be subjected to a partial rotation, always guided by the same mechanical element (140), phase or polarity of the male electric contact (200) being determined by a first relevant angular position between said key (270) and the angular position of the inner male contact (230) portion (231, 233) that must slide aside said mechanical element (140), phase or polarity of the corresponding female electric contact being determined by a second angular position of said guide groove (170) with respect to said mechanical element (140), said second angular position having the same absolute value and corresponding to said first angular position, said first and second angular position varying on the basis of the specific phase or polarity so that each male contact can be only introduced within a female contact having the same phase or polarity.

14. System according to claim 13, characterised in that shape of said inner male contact (230) is always the same, the position of a coupling transverse hole (236) varying so that coupling of said inner male contact (230) with the shell automatically determines said first angular position.

15. System according to claim 13, characterised in that said first angular position is 72° for ground unipolar connector, 144° for neutral unipolar connector, 36° for L1 phase unipolar connector, 108° for L2 phase unipolar connector, and 0° for L3 phase unipolar connector.

* * * * *